US011036165B2

(12) United States Patent
Tanaka

(10) Patent No.: US 11,036,165 B2
(45) Date of Patent: Jun. 15, 2021

(54) IMAGE FORMING APPARATUS

(71) Applicant: FUJI XEROX CO., LTD., Tokyo (JP)

(72) Inventor: Toshitaka Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/591,671

(22) Filed: Oct. 3, 2019

(65) Prior Publication Data

US 2020/0319579 A1 Oct. 8, 2020

(30) Foreign Application Priority Data

Apr. 2, 2019 (JP) ..... JP2019-070275

(51) Int. Cl.
*G03G 15/00* (2006.01)
*G03G 15/16* (2006.01)

(52) U.S. Cl.
CPC ..... *G03G 15/1615* (2013.01)

(58) Field of Classification Search
CPC .. G03G 15/01; G03G 15/1615; G03G 15/231; G03G 2215/548
USPC ..... 399/297–302, 306, 381, 388, 394, 397, 399/401
See application file for complete search history.

(56) References Cited

U.S. PATENT DOCUMENTS 6,718,146 B2 * 4/2004 Nakamori ..... G03G 15/2028 399/22
6,799,761 B2 * 10/2004 Kato ..... B65H 7/02 271/242
9,890,011 B2 * 2/2018 Tokuma ..... B65H 43/00
2017/0364008 A1 12/2017 Hayakawa

FOREIGN PATENT DOCUMENTS

JP 2003-220729 A 8/2003
JP 2005-10239 A 1/2005
JP 2017-223863 A 12/2017

* cited by examiner

*Primary Examiner* — Hoan H Tran
(74) *Attorney, Agent, or Firm* — Oliff PLC

(57) ABSTRACT

An image forming apparatus includes an image forming unit that forms an image on a recording medium, a reversal transport unit that reverses front and back sides of the recording medium having an image formed by the image forming unit, and then transports the recording medium to the image forming unit, a detection unit disposed in a transport path of the reversal transport unit to detect the position of the recording medium in a transverse direction transverse to a transport direction, the transport direction being the direction of transport of the recording medium, and an adjustment unit that adjusts the position of an image in the image forming unit in accordance with the position of the recording medium detected by the detection unit.

6 Claims, 12 Drawing Sheets

IMAGE FORMING APPARATUS

CROSS-REFERENCE TO RELATED APPLICATIONS

This application is based on and claims priority under 35 USC 119 from Japanese Patent Application No. 2019-070275 filed Apr. 2, 2019.

BACKGROUND

(i) Technical Field

The present disclosure relates to an image forming apparatus.

(ii) Related Art

Conventional image forming apparatuses form an image on recording paper after correcting the position of the recording paper in a direction transverse to its direction of transport. Examples of existing proposed techniques related to such image forming apparatuses include techniques described in Patent Literatures 1 to 3.

Japanese Unexamined Patent Application Publication No. 2017-223863 describes an image forming apparatus with which, if an imaging position where an image is formed on a second side of a preceding sheet is stored in a memory, a controller determines this imaging position to be the position at which to form an image on a second side of a given sheet, and controls movement of the sheet by a first transport unit, based on the determined imaging position and a detection result obtained by a detection unit.

Japanese Unexamined Patent Application Publication No. 2005-010239 describes an image forming apparatus including a misregistration amount detection unit to detect the amount of misregistration of a sheet being transported. In accordance with the detection result obtained by the misregistration amount detection unit, the position to be irradiated with light is corrected by a correction unit. Further, in accordance with the detection result from the misregistration amount detection unit, the position at which to write an image is controlled.

Japanese Unexamined Patent Application Publication No. 2003-220729 describes an image forming apparatus including a recording unit that, in accordance with the result of side edge detection by an edge sensor, adjusts a recording position in the main scanning direction, and then records an image on a sheet member being scanned and transported by a scanning and transport unit.

SUMMARY

Aspects of non-limiting embodiments of the present disclosure relate to improving the positional accuracy of an image formed on the back side of a recording medium without decreasing the productivity of an image forming process, in comparison to a case in which the position at which to form an image in an image forming unit is not adjusted based on the position of the recording medium detected by a detection unit that is disposed in the transport path of a reversal transport unit to detect the position of the recording medium in a direction transverse to its direction of transport.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including an image forming unit that forms an image on a recording medium, a reversal transport unit that reverses front and back sides of the recording medium having an image formed by the image forming unit, and then transports the recording medium to the image forming unit, a detection unit disposed in a transport path of the reversal transport unit to detect the position of the recording medium in a transverse direction transverse to a transport direction, the transport direction being the direction of transport of the recording medium, and an adjustment unit that adjusts the position of an image in the image forming unit in accordance with the position of the recording medium detected by the detection unit.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below with reference to the drawings.

Exemplary Embodiment 1

Figure 1:
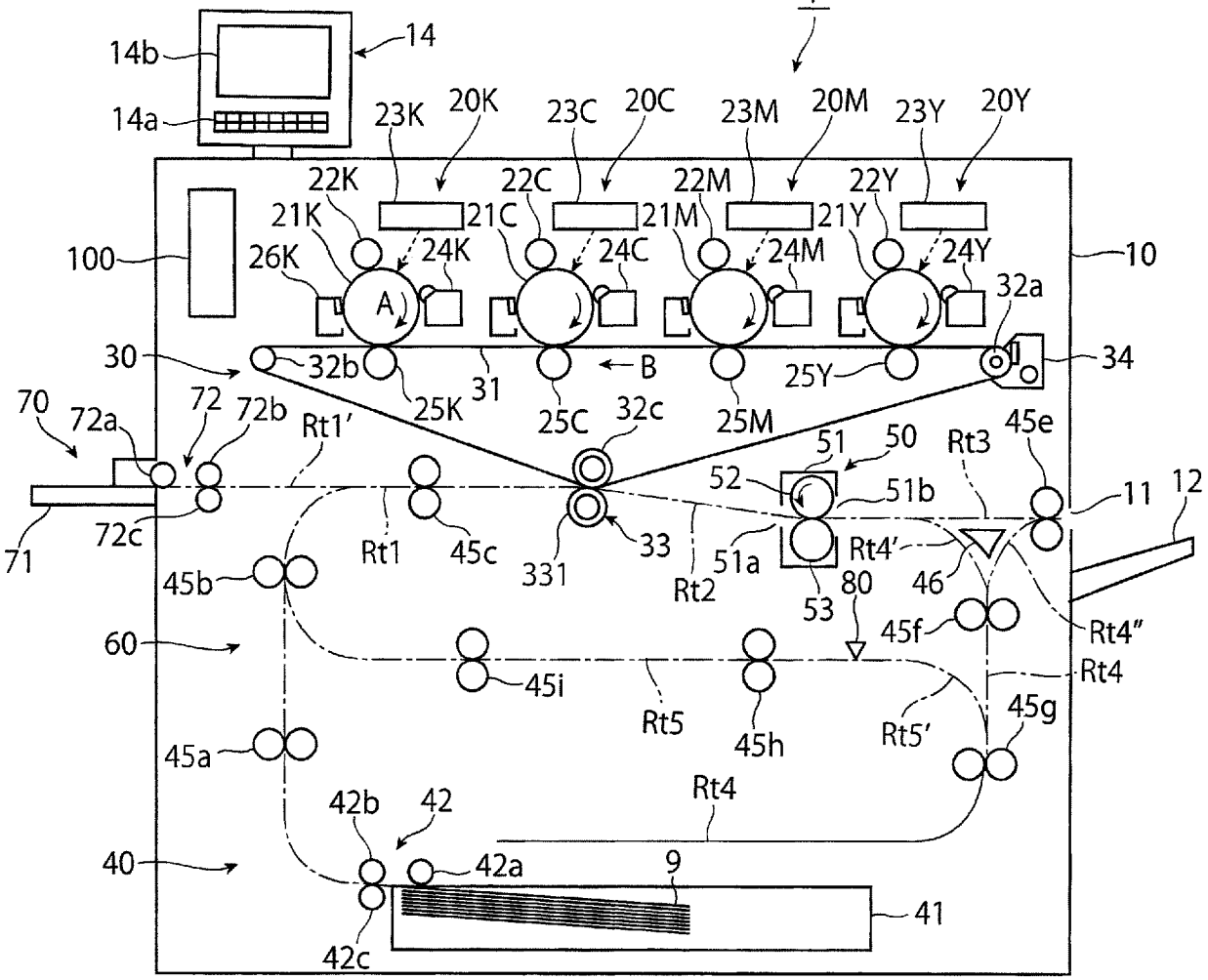
FIG. 1 illustrates the configuration of an image forming apparatus according to Exemplary Embodiment 1 of the present disclosure.
Figure 2:
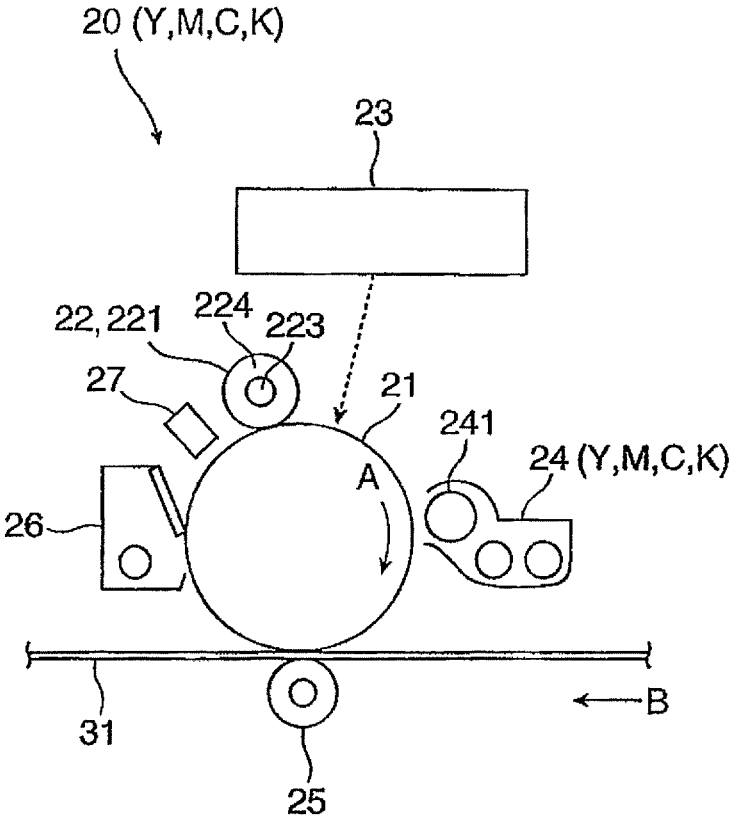
FIG. 2 illustrates the configuration of an image forming device according to Exemplary Embodiment 1 of the present disclosure.

FIGS. 1 and 2 illustrates an image forming apparatus according to Exemplary Embodiment 1. FIG. 1 illustrates the general arrangement of the image forming apparatus, and FIG. 2 is an enlarged view of the major portions (such as an imaging forming device) of the image forming apparatus.

General Configuration of Image Forming Apparatus

An image forming apparatus 1 is a full-color printer that employs an electrophotographic system to form, on recording paper 9 as an example of a recording medium, a final image made of toner based on image information including a character, a photograph, a geometrical figure, or other information. As illustrated in FIG. 1, the image forming apparatus 1 includes an apparatus body 10 having a generally box-shaped outward appearance. The image forming apparatus 1 includes the following and other components disposed inside the apparatus body 10: an image forming device 20 as an example of an image forming unit that forms a toner image made of toner, which is an example of developer; an intermediate transfer device 30 that temporarily carries a toner image formed by the image forming device 20 and transferred to the intermediate transfer device 30 through a first transfer process, and then transports the toner image to a second transfer position for second transfer to the recording paper 9; a paper feeding device 40 that accommodates and supplies the recording paper 9 to be supplied to the second transfer position of the intermediate transfer device 30; a fixing device 50 that fixes, onto the recording paper 9, a toner image transferred to the recording paper 9 through a second transfer process by the intermediate transfer device 30; and a sheet transport device 60 that transports the recording paper 9 fed from the paper feeding device 40 or other components along a predetermined transport path. For example, the support structure portion, exterior covering portion, or other portions of the apparatus body 10 are formed by using materials such as a support member or an exterior covering material. Alternate long and short dash lines in FIG. 1 represent a major transport path for the recording paper 9 inside the apparatus body 10.

The image forming apparatus 1 is also provided with components such as an operation/display device 14, and a control device 100. The operation/display device 14 is an example of an information presentation unit including an input unit 14*a*, which receives input of instructions, applied conditions, or other such information related to operation of the image forming apparatus 1, and a display 14*b* that displays various information such as applied conditions and state related to the operation. The control device 100 controls operation of the entire image forming apparatus 1 (such as the various devices mentioned above) in a centralized manner.

The image forming device 20 includes four image forming devices 20Y, 20M, 20C, and 20K that individually form images made by the following four colors of developer (toner): yellow (Y), magenta (M), cyan (C), and black (K). As illustrated in FIG. 1, 2, or other figures, each image forming device 20 (Y, M, C, or K) includes a photoconductor drum 21, which is an example of an image carrying unit rotationally driven in a direction indicated by an arrow A. Components such as a charging device 22, an exposure device 23, a developing device 24, a first transfer device 25, a drum cleaning device 26, and a charge eliminator 27 (see FIG. 2) are disposed around each photoconductor drum 21.

The photoconductor drum 21 is, for example, a photoconductor in the form of a drum having, on the periphery of a grounded cylindrical or columnar conductive base material, an imaging surface (area where an image can be formed) having a photodielectric layer (photoconductor layer) made of a photosensitive material. The photoconductor drum 21 is disposed so as to rotate as indicated by the arrow A upon supply of power from a driving device (not illustrated).

The charging device 22 is, for example, a contact charging device including a charging roller 221. The charging roller 221 is disposed in contact with the imaging surface of the photoconductor drum 21 so as to rotate following the rotation of the photoconductor drum 21, and receives supply of a predetermined charging bias having a negative polarity. As illustrated in FIG. 2, the charging roller 221 includes a conductive elastic layer 224 coated on the outer periphery of a columnar rotating shaft 223 made of metal. The charging device 22 to be used may not necessarily be a contact charging device but may be a non-contact charging device such as a scorotron.

The exposure device 23 is, for example, either a non-scanning exposure device including a light emitting diode and a component such as an optical part, or a scanning exposure device including a semiconductor laser and an optical part such as a polygon mirror. Image information input from an external source through a communicating unit, an image reading device, or other components, image information stored in an internal memory, or other such image information is input to the exposure device 23 in the form of an image signal decomposed into individual color components (Y, M, C, and K) after being subjected to a predetermined process in an image processing device 110 (see FIG. 6) described later. The exposure device 23 performs exposure according to the input image signal.

The developing device 24 is a developing device (Y, M, C, or K) using a two-component developer including a toner of one of the four colors (Y, M, C, and K) mentioned above and a magnetic carrier. The developing device 24 (Y, M, C, or K) is used so as to, for example, charge toner to a negative polarity to perform reversal development. Further, as illustrated in FIG. 2, the developing device 24 (Y, M, C, or K) includes components such as a developing roller 241. The developing roller 241 is an example of a developer carrying unit that carries a two-component developer accommodated in the housing of the developing device 24, and rotates so as to transport the two-component developer to a development region where the two-component developer faces the photoconductor drum 21. For example, a developing bias with the direct-current component superimposed on the alternating-current component is supplied between the developing roller 241 and the photoconductor drum 21.

The first transfer device 25 is, for example, a contact transfer device including a first transfer roller. The first transfer roller is disposed such that the first transfer roller comes into contact with a portion of the imaging surface of the photoconductor drum 21 that serves as a first transfer position (with an intermediate transfer belt 31 described later being interposed between the first transfer position and the first transfer device 25), and rotates following the rotation of the photoconductor drum 21. The first transfer roller also receives supply of a predetermined first transfer bias.

The drum cleaning device 26 includes, for example, a cleaning member such as an elastic plate. The cleaning member is disposed at a cleaning opening provided in the housing of the drum cleaning device 26 such that the cleaning member comes into contact with at least a portion of the imaging surface of the photoconductor drum 21 that has undergone a first transfer process, and scrapes away unwanted matter such as toner remaining on the imaging surface of the photoconductor drum 21.

The charge eliminator 27 removes charge from the imaging surface of the photoconductor drum 21 by a method such as exposing the imaging surface to light, thus making the potential of the surface substantially zero.

The intermediate transfer device 30 is positioned below the four image forming devices 20 (Y, M, C, and K). The intermediate transfer device 30 includes the intermediate transfer belt 31. The intermediate transfer belt 31 is an example of an intermediate transfer unit disposed so as to rotate as indicated by an arrow B while passing through each first transfer position where the photoconductor drum 21 of the image forming device 20 (Y, M, C, or K) faces the corresponding first transfer device 25.

The intermediate transfer belt 31 is formed as an endless belt with a predetermined thickness and a predetermined electrical resistance value, by using a material including a resistance regulating agent such as a carbon material dispersed in a base material such as polyimide resin or polyamide-imide resin.

The intermediate transfer belt 31 is passed over and rotatably supported by multiple support rollers 32*a* to 32*c*. The support roller 32*a* serves as a driving roller. The support roller 32*b* serves as a driven roller that holds the first transfer surface of the intermediate transfer belt 31 in cooperation with the support roller 32*a*. The support roller 32*c* serves as a second transfer backup roller.

The intermediate transfer device 30 includes components such as a second transfer device 33, and a belt cleaning device 34. The second transfer device 33 is an example of a transfer unit that performs a second transfer process whereby each toner image transferred onto the intermediate transfer belt 31 is transferred to the recording paper 9. The belt cleaning device 34 is an example of a cleaning unit of the intermediate transfer device 30 that cleans away unwanted matter such as residual toner adhering on the image carrying surface on the outer periphery of the intermediate transfer belt 31.

The second transfer device 33 used is, for example, a contact transfer device including a second transfer roller 331 disposed such that, during a normal image forming process, the second transfer roller 331 rotates in contact with a portion of the image carrying surface of the intermediate transfer belt 31 that is supported by the support roller 32*c*. The second transfer roller 331 of the second transfer device 33 is grounded. The support roller 32*c* receives, from a high-voltage power source (not illustrated), supply of a predetermined second transfer bias having a negative polarity, which is the same as the polarity of the charge on the toner. The second transfer roller 331 is disposed such that the second transfer roller 331 can be moved by a contact/separation unit toward or away from the support roller 32*c* at predetermined timing. Of course, as an alternative configuration, the second transfer roller 331 of the second transfer device 33 may receive supply of a predetermined second transfer bias having a positive polarity, which is opposite to the polarity of the charge on the toner, and the support roller 32*c* may be grounded.

The belt cleaning device 34 includes, for example, a cleaning member such as an elastic plate. The cleaning member is disposed at a cleaning opening provided in the housing of the belt cleaning device 34 such that the cleaning member comes into contact with at least a portion of the image carrying surface of the intermediate transfer belt 31 that has undergone a second transfer process, and scrapes away unwanted matter such as toner remaining on the image carrying surface of the intermediate transfer belt 31.

The paper feeding device 40 is positioned below the intermediate transfer device 30. The paper feeding device 40 includes an accommodation member 41, and a sending device 42. The accommodation member 41 is mounted in a manner that allows the accommodation member 41 to be pulled out from the apparatus body 10. The accommodation member 41 accommodates sheets of the recording paper 9 of, for example, a desired size or type that are stacked on a loading plate (not illustrated). The sending device 42 sends the recording paper 9 sheet by sheet from the accommodation member 41 toward a feed transport path. The sending device 42 includes a sending roller 42*a*, a supply roller 42*b*, and a separation roller 42*c*. The sending roller 42*a* sends the recording paper 9 sheet by sheet from the accommodation member 41 toward the feed transport path. The supply roller 42*b* is used to supply the recording paper 9 sent by the sending roller 42*a* toward the second transfer position. The separation roller 42*c* is used to prevent the recording paper 9 not in contact with the supply roller 42*b* from being transported, and thus separate the recording paper 9 sheet by sheet. The number of accommodation members 41 and the number of sending devices 42 may be increased or decreased as necessary.

The image forming apparatus 1 also includes a manual paper feeding device 70. The manual paper feeding device 70 is used with a side (left side face in FIG. 1) of the apparatus body 10 open. The manual paper feeding device 70 supplies the recording paper 9 of, for example, a desired size or type from a manual feed tray 71.

The manual paper feeding device 70 includes the manual feed tray 71, and a sending device 72. The manual feed tray 71 is attached on the left side of the apparatus body 10 in a manner that allows the manual feed tray 71 to be opened and closed. Sheets of the recording paper 9 of, for example, a desired size or type are placed on the manual feed tray 71 in a stacked state. The sending device 72 sends the recording paper 9 sheet by sheet from the manual feed tray 71 toward the feed transport path. The sending device 72 includes a sending roller 72*a*, a supply roller 72*b*, and a separation roller 72*c*. The sending roller 72*a* sends the recording paper 9 sheet by sheet from the manual feed tray 71 toward the feed transport path. The supply roller 72*b* is used to supply the recording paper 9 sent by the sending roller 72*a* toward the second transfer position. The separation roller 72*c* is used to prevent the recording paper 9 not in contact with the supply roller 72*b* from being transported, and thus separate the recording paper 9 sheet by sheet. An open/close sensor (not illustrated) is disposed on the apparatus body 10 of the image forming apparatus 1 to detect whether the manual feed tray 71 is open or closed. If the open/close sensor (not illustrated) detects that the manual feed tray 71 is open, the image forming apparatus 1 determines that the recording paper 9 is to be supplied not from the paper feeding device 40 but from the manual paper feeding device 70, and operates accordingly.

The recording paper 9 used may be any recording medium that can be transported through a transport path inside the apparatus body 10 and to which a toner image can be transferred and fixed. Examples of the recording paper 9 include plain paper used for devices employing an electrophotographic system, such as copiers or printers, thin paper such as tracing paper, and OHP sheets. From the viewpoint of improving the smoothness of the surface of an image obtained after a fixing process, the surface of the recording paper 9 is also desired to be as smooth as possible. Accordingly, other suitable examples of the recording paper 9 include coated paper with a material such as resin coated on the surface of plain paper, and so-called heavy paper with a relatively large basis weight, such as art paper used for printing.

Figure 3A:
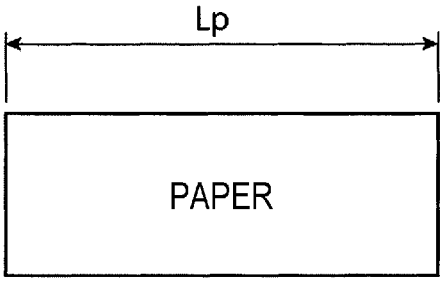
FIGS. 3A and 3B respectively illustrate long paper and common recording paper.
Figure 3B:
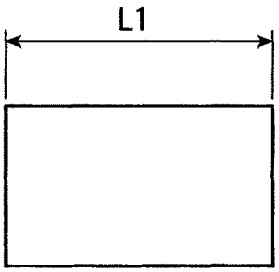

The image forming apparatus 1 allows use of, for example, so-called long paper 9*a*, which is an example of a long recording medium fed from the manual paper feeding device 70. As illustrated in FIGS. 3A and 3B, the long paper 9*a* refers to a type of recording paper having a length Lp (= about 450 to 1200 mm) in its direction of transport (to be also referred to simply as "transport direction" hereinafter) that is greater than the length L1 (=420 mm) in the transport direction of the recording paper 9 having the largest size (e.g., A3 size) among standard-size recording papers that can be normally used for image formation with the image forming apparatus 1. Examples of the long paper 9*a* include recording papers of various sizes, such as 210 mm×600 mm, 210 mm×900 mm, 297 mm×900 mm, and 297 mm×1200 mm. Of course, the long paper 9*a* may not necessarily have the above-mentioned sizes but may have other sizes.

The fixing device 50 is disposed downstream of the second transfer position of the intermediate transfer device 30 in the transport direction of the recording paper 9. In the fixing device 50, a heating rotary member 52 and a pressurizing rotary member 53 are placed inside a housing 51 having an entry opening 51*a* and an exit opening 51*b* through which the recording paper 9 enters and exits. The heating rotary member 52, which is in the form of a roller or a belt, rotates as indicated by an arrow, and is heated by a heating unit such that its surface temperature is maintained at a predefined temperature. The pressurizing rotary member 53, which is in the form of a roller or a belt, contacts the heating rotary member 52 at a predetermined pressure while being substantially aligned with the axial direction of the heating rotary member 52, and rotates following the rotation of the heating rotary member 52. A portion of the fixing device 50 where the heating rotary member 52 and the pressurizing rotary member 53 contact each other serves as a fixing processing part. The recording paper 9 carrying a toner image is introduced to the fixing processing part where a fixing process (application of heat and pressure) is performed on the recording paper 9.

In the image forming apparatus 1, the following major transport paths for the recording paper 9 are provided inside the apparatus body 10: a supply transport path Rt1 connecting between the paper feeding device 40 and the intermediate transfer device 30; an auxiliary supply transport path Rt1' connecting between the manual paper feeding device 70 and the intermediate transfer device 30; a relay transport path Rt2 connecting between the second transfer position of the intermediate transfer device 30 and the fixing device 50; an exit transport path Rt3 connecting between the fixing device 50 and a paper exit opening 11 of the apparatus body 10; a reversal transport path Rt4 that branches off downward from a point along the exit transport path Rt3 to reverse the front and back sides of the recording paper 9; and a duplex transport path Rt5 that branches off laterally from a point along the reversal transport path Rt4 to transport the recording paper 9 whose front and back sides have been reversed to the supply transport path Rt1.

The sheet transport device 60 transports the recording paper 9 along the supply transport path Rt1, the auxiliary supply transport path Rt1', the relay transport path Rt2, the exit transport path Rt3, the reversal transport path Rt4, and the duplex transport path Rt5.

The supply transport path Rt1 and the auxiliary supply transport path Rt1' are transport paths for respectively transporting and supplying the recording paper 9 sent from the paper feeding device 40 and the manual paper feeding device 70 to the second transfer position of the intermediate transfer device 30. The supply transport path Rt1 includes components such as multiple sheet transport roller pairs 45*a* to 45*c* that transport the recording paper 9 sent from the paper feeding device 40, and multiple sheet guide members (not illustrated). The auxiliary supply transport path Rt1' is used to directly transport the recording paper 9 sent from the manual paper feeding device 70 to the transport path Rt1. The auxiliary supply transport path Rt1' is joined to the supply transport path Rt1 at a location downstream of the sheet transport roller pair 45*c* in the transport direction of the recording paper 9.

The sheet transport roller pair 45*c*, which is positioned immediately before the second transfer position in the supply transport path Rt1, serves as, for example, registration rollers representing an example of a first transport unit that adjusts the transport timing of the recording paper 9. The sheet transport roller pair 45*b* serves as pre-registration rollers, which represent an example of a second transport unit disposed upstream of the sheet transport roller pair 45*c* in the transport direction of the recording paper 9.

Figure 4:
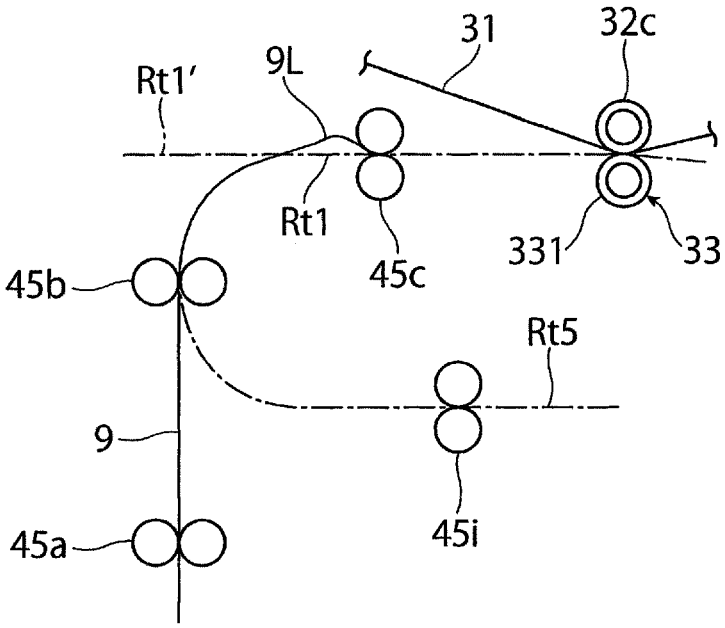
FIG. 4 illustrates the configuration of sheet transport rollers of the image forming apparatus according to Exemplary Embodiment 1 of the present disclosure.

As illustrated in FIG. 4, the sheet transport roller pair 45*b*, which serves as pre-registration rollers, transports the recording paper 9 such that the leading edge of the recording paper 9 comes into contact with the nip part of the sheet transport roller pair 45*c* that is in a stopped state. As the leading edge of the recording paper 9 is abutted against the nip part of the sheet transport roller pair 45*c* serving as registration rollers in a stopped state, the leading edge forms (curves into) a loop 9L. The leading edge of the recording paper 9 is thus registered so as to align with the axial direction of the sheet transport roller pair 45*c*.

Subsequently, the sheet transport roller pair 45*c*, which serve as registration rollers, begins to rotate in synchronization with a toner image that has been transferred onto the intermediate transfer belt 31 through the first transfer process, and transports the recording paper 9 together with the sheet transport roller pair 45*b* to the second transfer position of the intermediate transfer belt 31 where the second transfer roller 331 and the support roller 32*c* contact each other with the intermediate transfer belt 31 being interposed therebetween.

The relay transport path Rt2 is a transport path for transporting the recording paper 9 to the fixing device 50 after the second transfer process. In the relay transport path Rt2, a component such as a transport belt is disposed as necessary to transport the recording paper 9 after the second transfer process. The exit transport path Rt3 is a transport path for transporting the recording paper 9 having an image fixed thereto, such that the recording paper 9 is transported by an exit roller pair 45*e* to exit through the paper exit opening 11 of the apparatus body 10 to an exit accommodation unit 12.

The exit transport path Rt3 includes a component such as the exit roller pair 45*e*, and a sheet guide member (not illustrated). The reversal transport path Rt4 has the following transport paths in its upper end portion: a lead-in transport path Rt4' that branches off downward in a curved shape from a point along the exit transport path Rt3; and a lead-out transport path Rt4" formed in an upwardly curved shape so as to join the exit transport path Rt3 at a location upstream of the exit roller pair 45*e* in the transport direction of the recording paper 9. The lead-out transport path Rt4" is used for cases such as when reversing the front and back sides of the recording paper 9 as the recording paper 9 is discharged to the exit accommodation unit 12 by the exit roller pair 45*e*. A switching member 46 is disposed in an upper end portion of the reversal transport path Rt4. The switching member 46 switches the transport direction of the recording paper 9 such that the recording paper 9 is diverted downward from the exit transport path Rt3. A sheet transport roller pair 45*f* is disposed in an upper portion of the reversal transport path Rt4 to transport the recording paper 9 into the reversal transport path Rt4. Further, a sheet transport roller pair 45*g* whose rotational direction can be switched between forward and reverse is disposed in an intermediate portion of the reversal transport path Rt4. The reversal transport path Rt4, and a component that transports the recording paper 9 along the reversal transport path Rt4 constitute a reversal transport unit. The reversal transport path Rt4 has a relatively long transport path extending over to an upper portion of the paper feeding device 40 to allow handling of the long paper 9*a*, which is an example of a recording medium.

The duplex transport path Rt5 includes multiple duplex transport roller pairs 45*h* and 45*i*, multiple sheet guide members (not illustrated), and other components. The duplex transport roller pairs 45*h* and 45*i* are disposed in a horizontal transport path through which the recording paper 9 is transported to the supply transport path Rt1 after having its front and back sides reversed in the reversal transport path Rt4. An upstream end portion Rt5' of the duplex transport path Rt5 with respect to the transport direction of the recording paper 9 is formed by a component such as a sheet guide member (not illustrated) having a curved shape, which branches off laterally to the left from an intermediate portion of the reversal transport path Rt4. An area of the duplex transport path Rt5 that continues downstream from the upstream end portion Rt5' is formed in a planar shape with respect to the horizontal direction.

The auxiliary supply transport path Rt1', which transports the recording paper 9 from the manual paper feeding device 70 to the second transfer position of the intermediate transfer device 30, is disposed substantially linearly in the direction in which the recording paper 9 is transported by the sheet transport roller pair 45*c*.

Basic Image Forming Operation Performed by Image Forming Apparatus

The image forming apparatus 1 performs a basic image forming operation described below. The following description will be directed to an exemplary operation for forming a full-color image by a combination of toner images of four colors (Y, M, C, and K).

First, when the control device 100 of the image forming apparatus 1 receives a command requesting image formation from an external or other source, in each of the four image forming devices 20 (Y, M, C, and K), the corresponding photoconductor drum 21 is rotated as indicated by the arrow A, and the charging device 22 is supplied with a charging current and generates a contact discharge. The imaging surface of each photoconductor drum 21 is thus charged to a predetermined polarity (e.g., a negative polarity) and a predetermined potential.

Subsequently, each exposure device 23 exposes the charged imaging surface of the corresponding photoconductor drum 21 to light according to an image signal decomposed into each corresponding color component (Y, M, C, or K). This creates, on the imaging surface of each photoconductor drum 21, an electrostatic latent image for the corresponding color component with a predetermined potential.

Subsequently, each developing device 24 (Y, M, C, or K) supplies, from the developing roller 241, a toner of the corresponding color (Y, M, C, or K) charged to a predetermined polarity (negative polarity). Further, a developing electric field generated between the developing roller 241 and the photoconductor drum 21 upon supply of a charging bias causes the toner to statically adhere to the electrostatic latent image of each color component formed on the imaging surface of the photoconductor drum 21. Thus, a toner image of one of the four colors (Y, M, C, and K) is formed individually on the imaging surface of the corresponding photoconductor drum 21.

Subsequently, each first transfer device 25 generates a first transfer electric field between the first transfer device 25 and the corresponding photoconductor drum 21 upon supply of a first transfer current. A first transfer process is thus performed whereby toner images on the respective photoconductor drums 21 are transferred sequentially (in the order of Y, M, C, and K) to the image carrying surface of the intermediate transfer belt 31 of the intermediate transfer device 30. The drum cleaning device 26 cleans the imaging surface of each photoconductor drum 21 that has undergone the first transfer or other process. Further, the charge eliminator 27 removes charge from the imaging surface of the photoconductor drum 21 that has undergone the first transfer or other process, thus preparing the photoconductor drum 21 for the next image forming operation.

Then, as the intermediate transfer belt 31 rotates as indicated by the arrow B in the intermediate transfer device 30, an unfixed toner image transferred through the first transfer process and carried on the image carrying surface of the intermediate transfer belt 31 is transported to the second transfer position where the toner image faces the second transfer device 33. Meanwhile, after a predetermined sheet of the recording paper 9 is sent to the supply transport path Rt1 or the auxiliary supply transport path Rt1' from the accommodation member 41 or the manual feed tray 71 by the sending device 42 or 72 of the paper feeding device 40 or the manual paper feeding device 70, the recording paper 9 is supplied so as to reach the second transfer position of the intermediate transfer device 30 via the supply transport path Rt1 or the auxiliary supply transport path Rt1'. At the second transfer position, as a second transfer electric field is generated between the second transfer device 33 and the intermediate transfer belt 31 upon supply of a second transfer bias to the second transfer device 33, a second transfer process is performed whereby toner images of four colors present on the intermediate transfer belt 31 are transferred to one side of the recording paper 9.

Subsequently, the recording paper 9 with the unfixed toner image transferred thereto through the second transfer process is stripped off from the intermediate transfer belt 31. Then, the recording paper 9 is transported so as to reach the fixing device 50 via the relay transport path Rt2. In the fixing device 50, heat and pressure are applied to the recording paper 9 as the recording paper 9 is introduced to and passes through the fixing processing part where the heating rotary member 52 and the pressurizing rotary member 53 are in contact with each other. This causes the toner constituting the toner image to melt under applied pressure, and the toner image is thus fixed onto the recording paper 9.

Subsequently, the recording paper 9 with the fixed toner image is discharged from the interior of the housing 51 of the fixing device 50. The recording paper 9 is then transported via the exit transport path Rt3. Lastly, the recording paper 9 exits through the paper exit opening 11 to the outside of the apparatus body 10, and is accommodated into the exit accommodation unit 12.

In the case of forming an image on both sides of the recording paper 9, after an image is formed on one side of the recording paper 9, the resulting recording paper 9 is not discharged to the exit accommodation unit 12 but transported from the exit transport path Rt3 to the reversal transport path Rt4 by means of the switching member 46. The sheet transport roller pair 45*g* in the reversal transport path Rt4 nips the leading edge of the recording paper 9 being transported. Then, in this state, the direction of rotation of the sheet transport roller pair 45*g* is changed from the forward to reverse direction, causing the front and back sides of the recording paper 9 to be reversed. The sheet transport roller pair 45*g* then transports the recording paper 9, which is now in the reserved state, to the duplex transport path Rt5. As the recording paper 9 transported to the duplex transport path Rt5 passes through the supply transport path Rt1, a toner image is transferred to the back side of the recording paper 9. Subsequently, the recording paper 9 is transported to the fixing device 50 via the relay transport path Rt2, subjected to a fixing process (application of heat and pressure) by the fixing device 50, and then accommodated into the exit accommodation unit 12 via the exit transport path Rt3.

Through the above-mentioned operation, a single sheet of the recording paper 9 with a full-color image formed on one or both sides is output. If a command requesting image formation on multiple sheets of recording paper is received, the above-mentioned image forming operation is repeated similarly for a number of times corresponding to the number of sheets.

Alternatively or additionally, in the above-mentioned image forming operation of the image forming apparatus 1, it is also possible to form a monochrome image by activating one of the four image forming devices 20 (Y, M, C, and K), or form a color image other than a full-color image by activating a combination of two or three of the four image forming devices 20 (Y, M, C, and K).

Configuration of Characteristic Features of Image Forming Apparatus

Figure 5:
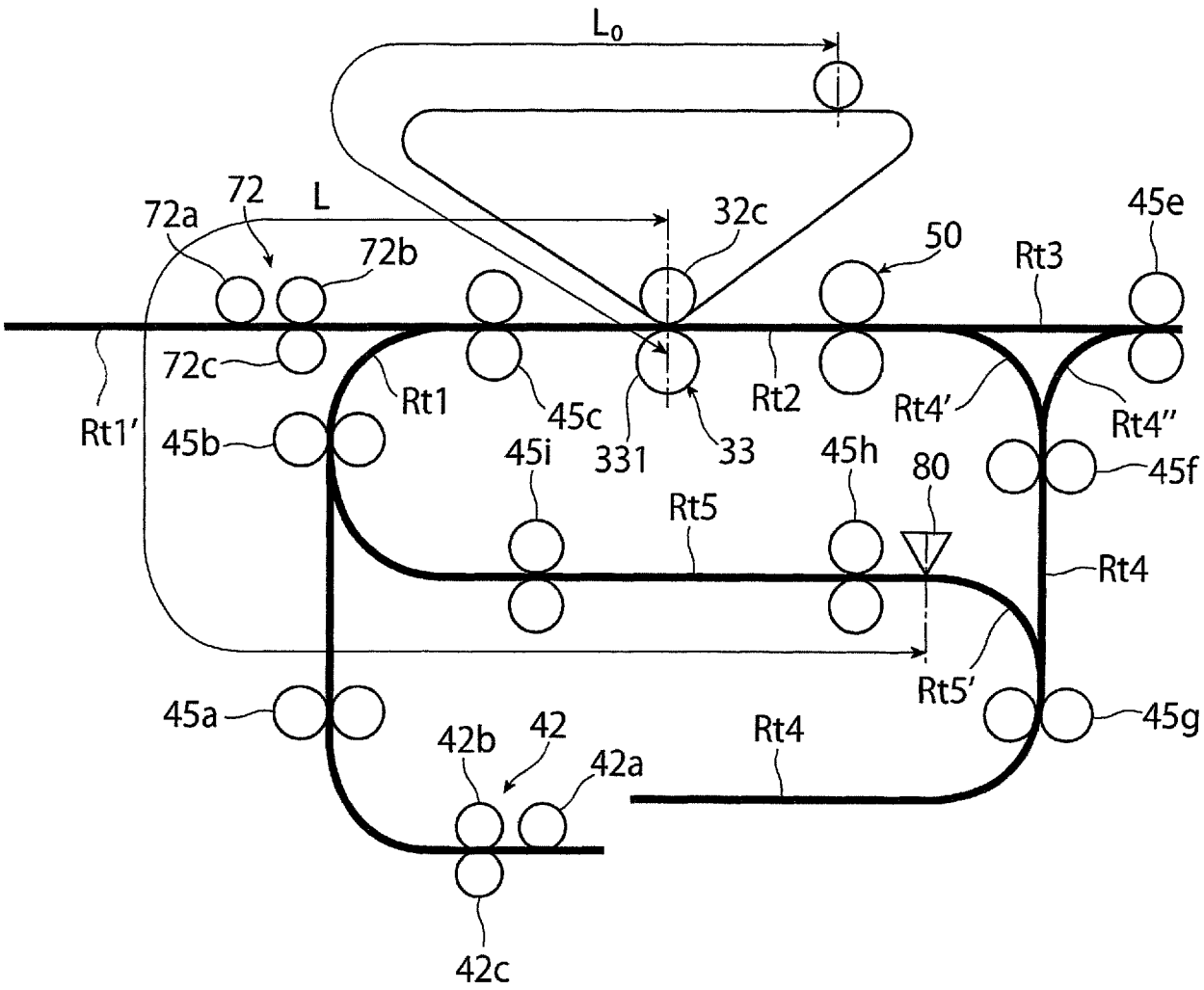
FIG. 5 illustrates the configuration of a transfer device of the image forming apparatus according to Exemplary Embodiment 1 of the present disclosure.

As illustrated in FIGS. 1 and 5, the image forming apparatus 1 according to Exemplary Embodiment 1 includes the following transport paths for transporting the recording paper 9: the supply transport path Rt1, the auxiliary supply transport path Rt1', the relay transport path Rt2, the exit transport path Rt3, the reversal transport path Rt4, and the duplex transport path Rt5.

As illustrated in FIG. 5, the image forming apparatus 1 forms an image on both sides of the recording paper 9 as described below. First, after an image is formed on one side of the recording paper 9, the resulting recording paper 9 is temporarily transported into the reversal transport path Rt4 by the sheet transport roller pair 45*g*. Then, with the trailing edge of the recording paper 9 nipped by the sheet transport roller pair 45*g*, the direction of rotation of the sheet transport roller pair 45*g* is reversed to transport the recording paper 9 from the reversal transport path Rt4 to the supply transport path Rt1 via the duplex transport path Rt5. An image is thus formed on the back side of the recording paper 9. A switching member (not illustrated) made of a material such as a Mylar film (not illustrated) is disposed at the branch position between the reversal transport path Rt4 and the duplex transport path Rt5. As the trailing edge of the long paper 9*a* as the recording paper 9 passes through the switching member, the transport path for the long paper 9*a* is switched from the reversal transport path Rt4 to the duplex transport path Rt5.

At the time of the above-mentioned operation in the image forming apparatus 1, that is, when the recording paper 9 is temporarily transported into the reversal transport path Rt4 by the sheet transport roller pair 45*g*, and has its transport direction reversed by the sheet transport roller pair 45*g* such that the transport path for the recording paper 9 is changed from the reversal transport path Rt4 to the duplex transport path Rt5, it is necessary to transport the recording paper 9 only by the sheet transport roller pair 45*g*, and it is also necessary to transport the recording paper 9 to the duplex transport path Rt5 via the curved upstream end portion Rt5', which is an edge portion of the duplex transport path Rt5 located upstream in the transport direction. Accordingly, if there are variations in the contact resistance between the recording paper 9 and the upstream end portion Rt5' in a direction transverse to the transport direction of the recording paper 9 (to be also referred to simply as "transverse direction" hereinafter), or if there is an error in the outer diameter or mounting position of the sheet transport roller pair 45*g*, such variations or error may, in some cases, cause the recording paper 9 to be displaced in the transverse direction during its transport to the duplex transport path Rt5. At this time, since the long paper 9*a* as an example of a recording medium has a large length along the transport direction in comparison to common recording paper 9 as illustrated in FIGS. 3A and 3B, misregistration or skew tends to occur in the transverse direction as the long paper 9*a* is transported from the reversal transport path Rt4 to the duplex transport path Rt5 by the sheet transport roller pair 45*g*.

To address this, the image forming apparatus 1 according to Exemplary Embodiment 1 includes a detection unit disposed in the transport path of the reversal transport unit to detect the position of a recording medium in the transverse direction transverse to the transport direction, and an adjustment unit that adjusts the position of an image in the image forming unit in accordance with the position of the recording medium detected by the detection unit.

That is, in Exemplary Embodiment 1, as illustrated in FIGS. 1 and 5, a sheet sensor 80 is disposed in the duplex transport path Rt5 as an example of a detection unit to detect the position of the recording paper 9 in the transverse direction. The sheet sensor 80 is disposed in a planar portion of the duplex transport path Rt5 located downstream of the curved upstream end portion Rt5' of the duplex transport path Rt5 in the transport direction. An example of the sheet sensor 80 is a contact image sensor (CIS) that, at a location in contact with or proximate to the recording paper 9, detects the position of an edge portion of the recording paper 9 in the transverse direction. A detection signal obtained by the sheet sensor 80 is input to the control device 100, which also functions as an adjustment unit.

The sheet sensor 80 is disposed at a location such that a transport path length L is greater than a length $L_0$. The transport path length L is the length, in the transport direction of the recording paper 9, of a transport path from the sheet sensor 80 to the second transfer position where the second transfer roller 331 and the support roller 32*c* contact each other. The length $L_0$ is the length, in the direction of movement of the intermediate transfer belt 31, from the second transfer position where the second transfer roller 331 and the support roller 32*c* contact each other, to the first transfer position where a photoconductor drum 21Y of the image forming device 20Y for yellow (Y), which is the most upstream image forming device in the direction of movement of the intermediate transfer belt 31, contacts a first transfer device 25Y with the intermediate transfer belt 31 being interposed between the photoconductor drum 21Y and the first transfer device 25Y.

The above-mentioned configuration is employed to secure a sufficient amount of time for adjusting the position at which an image is formed by the image forming device 20Y for yellow (Y), which is the first image forming device that forms an image based on the detection signal from the sheet sensor 80 after an edge portion of the recording paper 9 in the transverse direction is detected by the sheet sensor 80.

Figure 6:
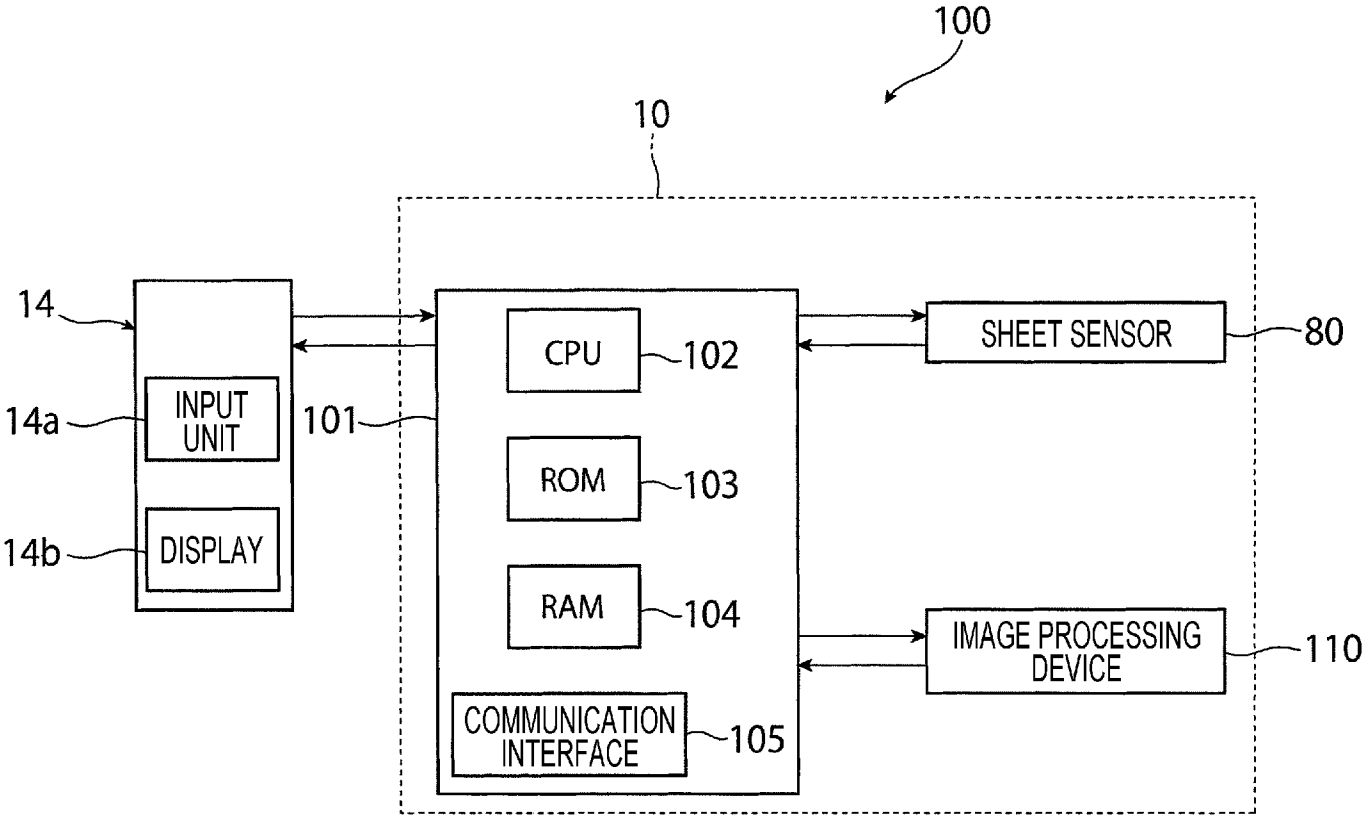
FIG. 6 is a block diagram illustrating a control device of the image forming apparatus according to Exemplary Embodiment 1 of the present disclosure.

FIG. 6 is a block diagram illustrating the control device of the image forming apparatus.

In FIG. 6, reference numeral 101 denotes a controller serving as an example of a control unit of the control device 100 that controls operation of the image forming apparatus 1 in a centralized manner. The controller 101 includes components such as a central processing unit (CPU) 102, a read only memory (ROM) 103, a random access memory (RAM) 104, and a communication interface 105. The CPU 102 controls an image forming operation in a centralized manner. The ROM 103 stores, for example, a control program executed by the CPU 102. The RAM 104 stores a parameter or other information used by, for example, a control program executed by the CPU 102. The communication interface 105 communicates with, for example, a bus that interconnects the CPU 102, the ROM 103, and other components, an external personal computer, and an image reading apparatus.

A detection signal obtained by detecting the recording paper 9 is input from the sheet sensor 80 to the controller 101 as appropriate. In the controller 101, based on the detection signal from the sheet sensor 80, the position at which to form an image in each of the image forming devices 20 (Y, M, C, and K) for yellow (Y), magenta (M), cyan (C), and black (K) is adjusted (controlled) by the image processing device 110, which is an example of an adjustment unit, by a method such as shifting the image position in the main scanning direction on an image memory in which image data is deployed, or rotating image data by tilting the image data with respect to the sub-scanning direction.

The controller 101 is connected with the operation/display device 14. The controller 101 receives various commands from the input unit 14*a* of the operation/display device 14, and executes displaying of predetermined information on the display 14*b*.

Operation of Image Forming Apparatus

With the image forming apparatus 1 according to Exemplary Embodiment 1, the positional accuracy of an image formed on the back side of a recording medium is improved as follows without decreasing the productivity of an image forming process, in comparison to a case in which the position at which to form an image in an image forming unit is not adjusted based on the position of the recording medium detected by a detection unit that is disposed in the transport path of a reversal transport unit to detect the position of the recording medium in the transverse direction transverse to the transport direction.

That is, as illustrated in FIGS. 1 and 5, in forming an image on both sides of the long paper 9*a* as a recording medium with the image forming apparatus 1 according to Exemplary Embodiment 1, the long paper 9*a* is set on the manual feed tray 71 of the manual paper feeding device 70. When an instruction to start image formation is provided from a component such as the input unit 14*a* of the operation/display device 14, the long paper 9*a* is sent from the manual feed tray 71 to the auxiliary supply transport path Rt1' by the sending device 72. The long paper 9*a* is then transported so as to reach the second transfer position of the intermediate transfer device 30 via the supply transport path Rt1. At the second transfer position, as a second transfer electric field is generated between the second transfer device 33 and the intermediate transfer belt 31 upon supply of a second transfer bias to the second transfer device 33, a second transfer process is performed whereby toner images of four colors present on the intermediate transfer belt 31 are transferred to one side of the long paper 9*a*.

Prior to the above-mentioned process, in each of the image forming devices 20 (Y, M, C, and K) for yellow (Y), magenta (M), cyan (C), and black (K) in the image forming apparatus 1, a toner image of the corresponding color is formed after undergoing, in the image processing device 110, predetermined image processing including adjustment of the position at which to form an image, and the resulting toner image is then transferred onto the intermediate transfer belt 31.

Subsequently, the long paper 9*a* with an unfixed toner image transferred thereto through the second transfer process is sent via the relay transport path Rt2 to the fixing device 50 and undergoes a fixing process. After the toner image is thus fixed to the long paper 9*a*, the resulting long paper 9*a* is transported from the exit transport path Rt3 to the reversal transport path Rt4 by the switching member 46. The sheet transport roller pair 45*g* in the reversal transport path Rt4 temporarily holds the transported long paper 9*a* within the reversal transport path Rt4. The sheet transport roller pair 45*g* in the reversal transport path Rt4 nips the leading edge of the long paper 9*a* being transported. Then, in this state, the direction of rotation of the sheet transport roller pair 45*g* is changed from the forward to reverse direction, causing the front and back sides of the long paper 9*a* to be reversed. The sheet transport roller pair 45*g* then transports the long paper 9*a*, which is now in the reversed state, to the duplex transport path Rt5. An image is thus formed on the back side of the long paper 9*a*. Subsequently, the long paper 9*a* is transported to the fixing device 50 via the relay transport path Rt2, subjected to a fixing process (application of heat and pressure) by the fixing device 50, and then accommodated into the exit accommodation unit 12 via the exit transport path Rt3.

At this time, after the trailing edge of the long paper 9*a* in the transport direction is temporarily transported into the reversal transport path Rt4, the long paper 9*a* is reversed in its transport direction while having its trailing edge nipped by the sheet transport roller pair 45*g* in the reversal transport path Rt4. The long paper 9*a* is then transported to the duplex transport path Rt5.

Figure 7:
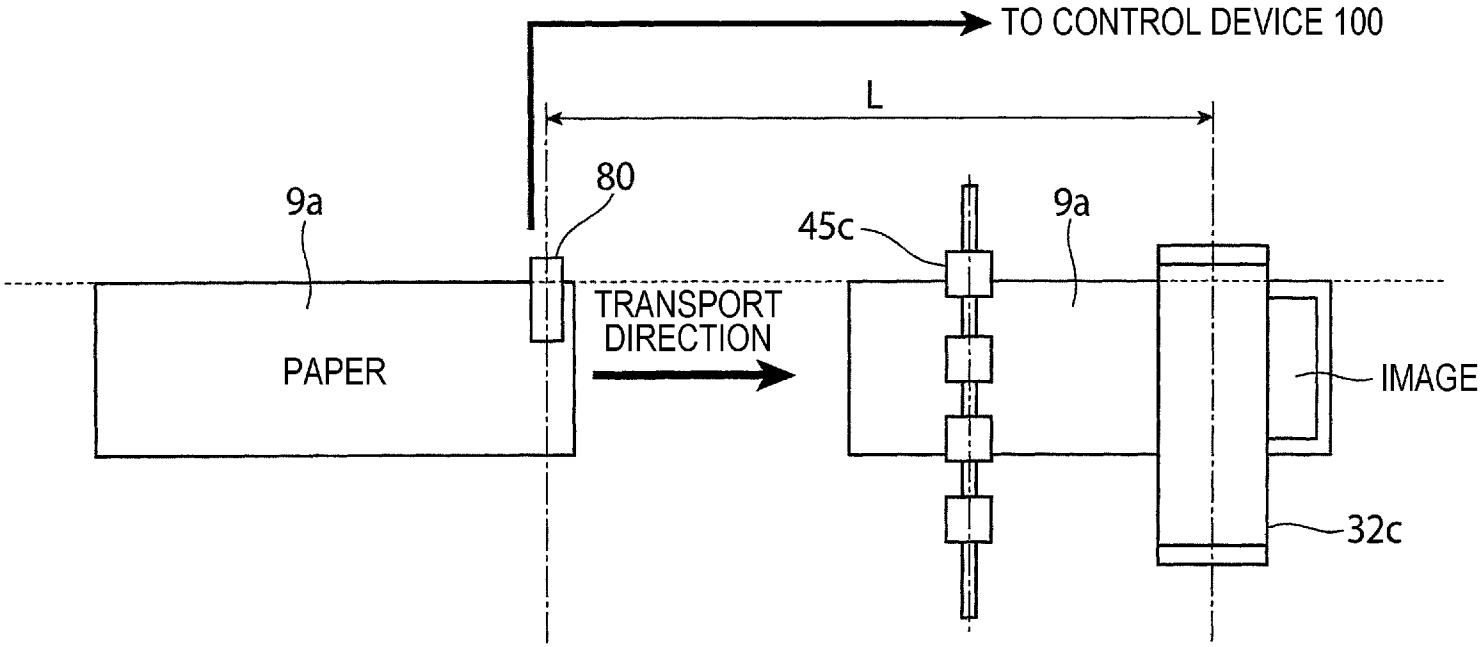
FIG. 7 illustrates operation of the image forming apparatus according to Exemplary Embodiment 1 of the present disclosure.

As illustrated in FIG. 7, as the long paper 9*a* is transported to the duplex transport path Rt5, the position of an edge portion of the long paper 9*a* in the transverse direction is detected only once by the sheet sensor 80 disposed in the duplex transport path Rt5, at a location corresponding to the leading edge of the long paper 9*a* in the transport direction. A detection signal obtained by the sheet sensor 80 is sent to the controller 101 of the control device 100.

When the controller 101 of the control device 100 determines that the edge portion of the long paper 9*a* in the transverse direction is positioned properly, an image for the back side is formed at a position where an image is normally formed in each of the image forming devices 20 (Y, M, C, and K) for yellow (Y), magenta (M), cyan (C), and black (K), and images of various colors such as yellow (Y), magenta (M), cyan (C), and black (K) are transferred at once to the back side of the long paper 9*a* to thereby form, for example, a full-color image.

At this time, the leading edge of the long paper 9*a* is abutted against the sheet transport roller pair 45*c* serving as registration rollers. The leading edge position of the long paper 9*a* is thus properly aligned.

Figure 8:
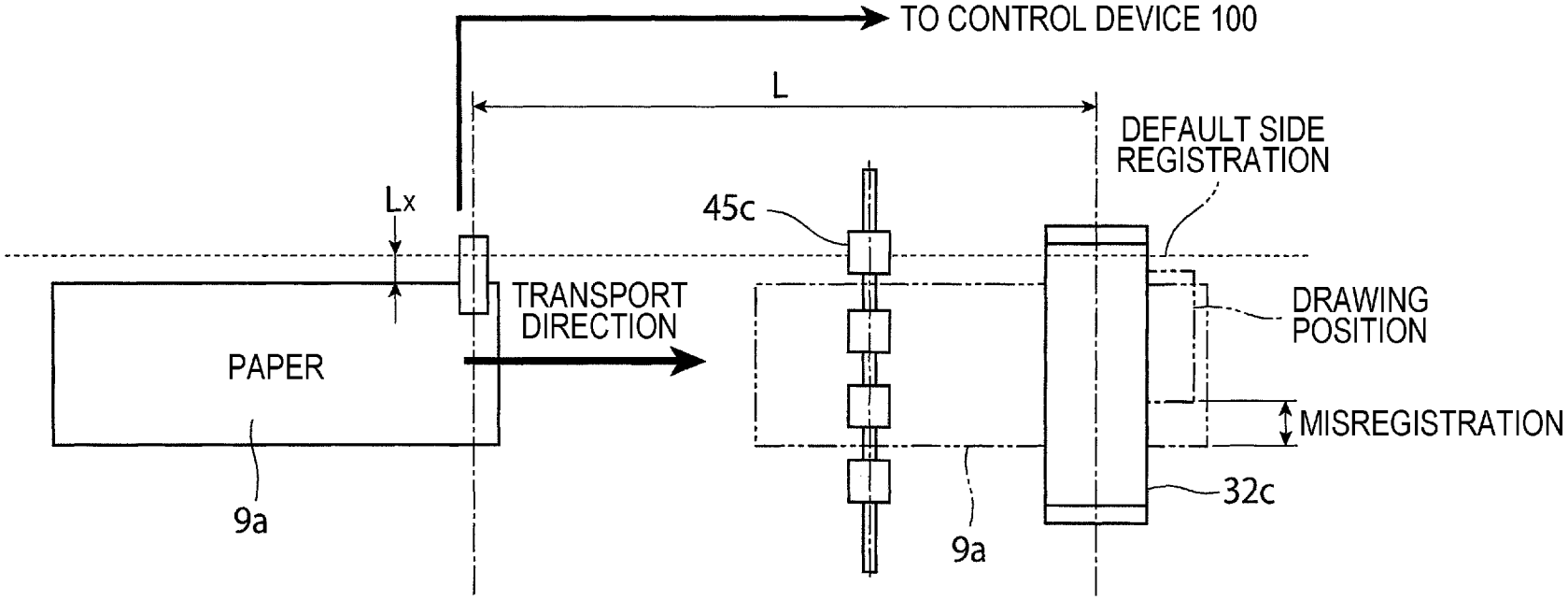
FIG. 8 illustrates operation of the image forming apparatus according to Exemplary Embodiment 1 of the present disclosure.
Figure 9:
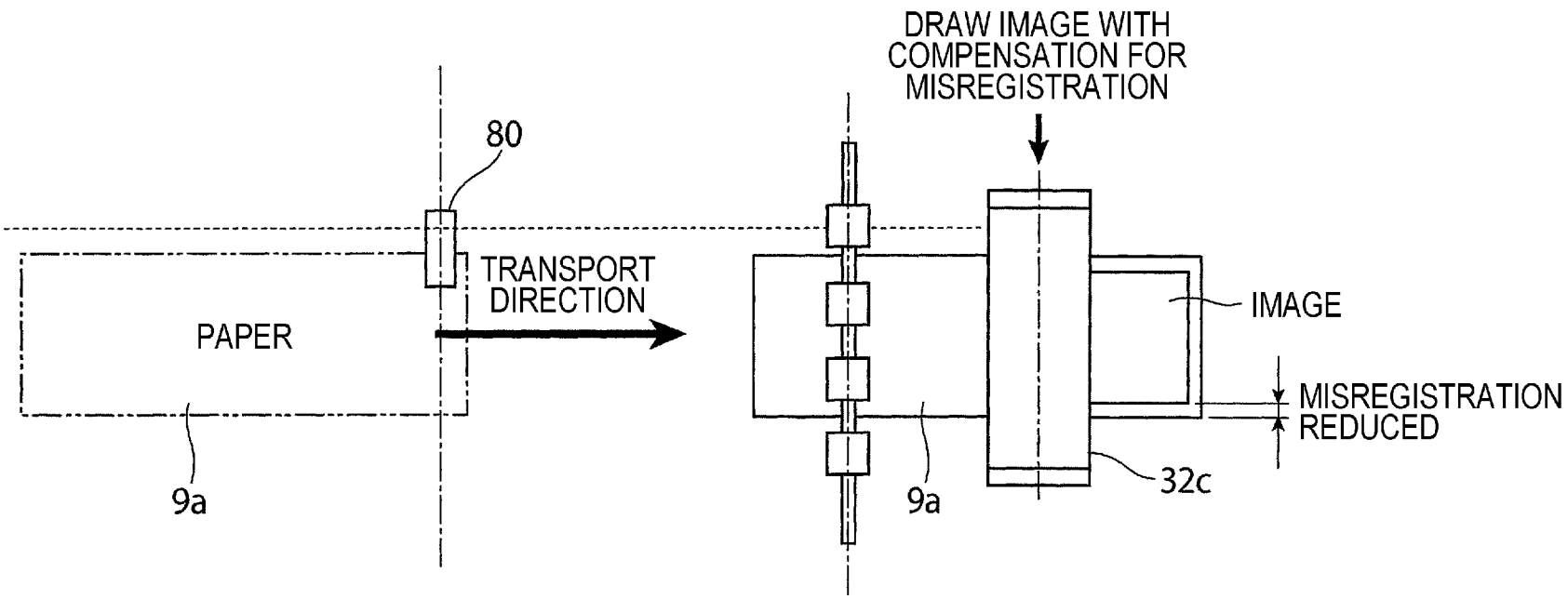
FIG. 9 illustrates operation of the image forming apparatus according to Exemplary Embodiment 1 of the present disclosure.

As illustrated in FIG. 8, if, based on the detection result from the sheet sensor 80, the controller 101 of the control device 100 determines that an edge portion of the long paper 9*a* in the transverse direction is displaced with respect to the proper position by an amount of misregistration $L_X$, then as illustrated in FIG. 9, in each of the image forming devices 20 (Y, M, C, and K) for yellow (Y), magenta (M), cyan (C), and black (K), an image is formed at a position that is displaced, with respect to a position at which an image is normally formed, by a distance corresponding to the amount of misregistration $L_X$ of the edge portion of the long paper 9*a*.

As described above, with the image forming apparatus 1, even if the long paper 9*a* has misregistration in the transverse direction, the position at which to form an image is controlled (adjusted) in accordance with the amount of misregistration $L_X$ of an edge portion of the long paper 9*a* in the transverse direction. This prevents or reduces misregistration from occurring in an image formed on the back side of the long paper 9*a*.

Figure 10A:
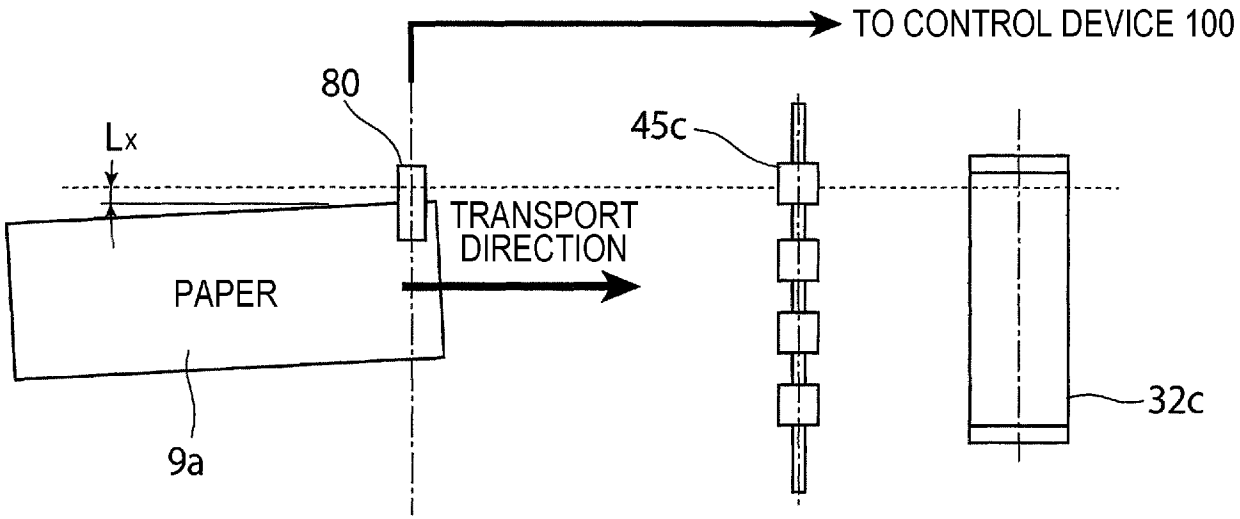
FIGS. 10A and 10B illustrate operation of the image forming apparatus according to Exemplary Embodiment 1 of the present disclosure.
Figure 10B:
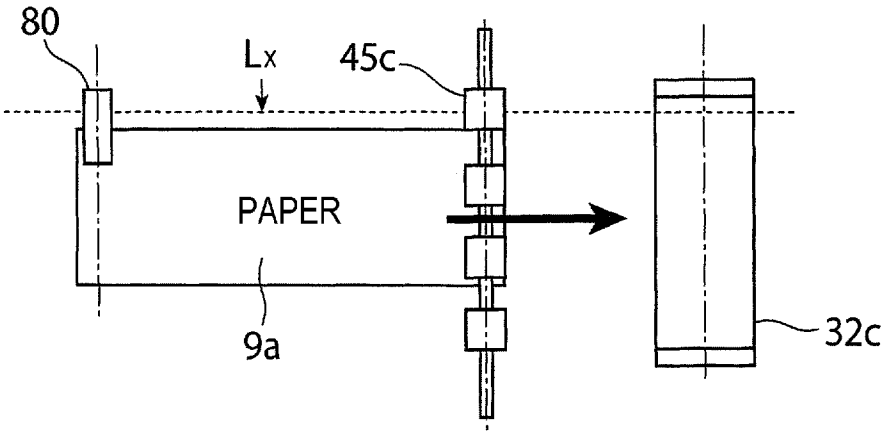

As illustrated in FIGS. 10A and 10B, with the controller 101 of the control device 100, the position of an edge portion of the long paper 9*a* in the transverse direction is detected by the sheet sensor 80 at a location corresponding to the leading edge of the long paper 9*a* in the transport direction. Misregistration of the long paper 9*a* is thus detected. In the illustrated example, the long paper 9*a* has skew in addition to misregistration.

As illustrated in FIG. 10A, in this case, based on the detection result from the sheet sensor 80, the controller 101 of the control device 100 determines that the edge portion of the long paper 9*a* in the transverse direction is displaced by the amount of misregistration $L_X$ with respect to the proper position.

Then, as illustrated in FIG. 10B, the controller 101 of the control device 100 corrects the skew of the long paper 9*a* by abutting the leading edge of the long paper 9*a* against the sheet transport roller pair 45*c* serving as registration rollers.

Figure 11:
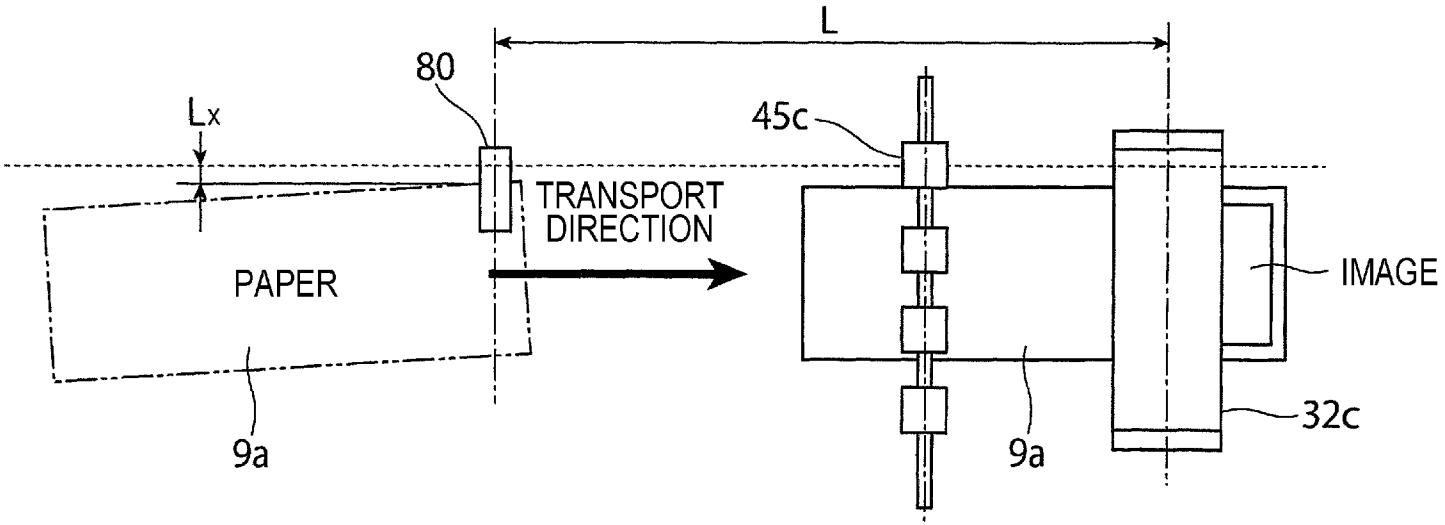
FIG. 11 illustrates operation of the image forming apparatus according to Exemplary Embodiment 1 of the present disclosure.

Subsequently, as illustrated in FIG. 11, the controller 101 causes an image to be formed at a position that is displaced, by the amount of misregistration $L_X$ corresponding to the amount of misregistration of the edge portion of the long paper 9*a*, with respect to a position where an image is normally formed in each of the image forming devices 20 (Y, M, C, and K) for yellow (Y), magenta (M), cyan (C), and black (K). This prevents or reduces misregistration from occurring in an image formed on the back side of the long paper 9*a* due to misregistration and skew.

It is to be noted that in the above-mentioned case, the long paper 9*a* has skew in addition to misregistration. Accordingly, in correcting the skew of the long paper 9*a* by abutting the long paper 9*a* against the sheet transport roller pair 45*c*, additional misregistration may occur in the long paper 9*a*.

In such a case, the controller 101 predicts the amount of additional misregistration introduced in correcting the skew of the long paper 9*a*, and accordingly displaces the position of an image in each of the image forming devices 20 (Y, M, C, and K) for yellow (Y), magenta (M), cyan (C), and black (K). This makes it possible to reduce misregistration introduced in correcting skew.

Exemplary Embodiment 2

Figure 12A:
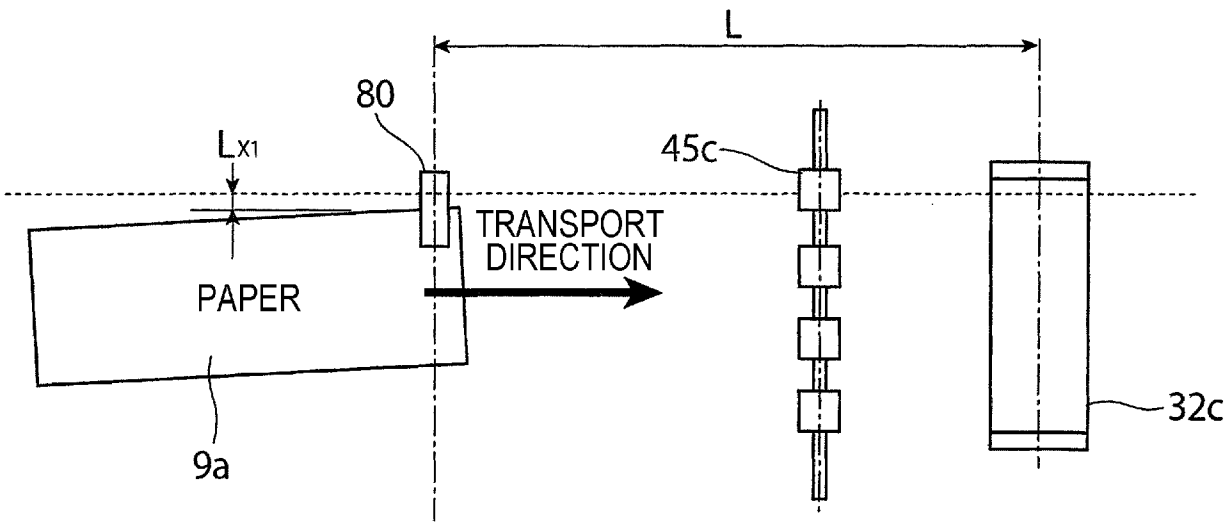
FIGS. 12A and 12B illustrate operation of an image forming apparatus according to Exemplary Embodiment 2 of the present disclosure.
Figure 12B:
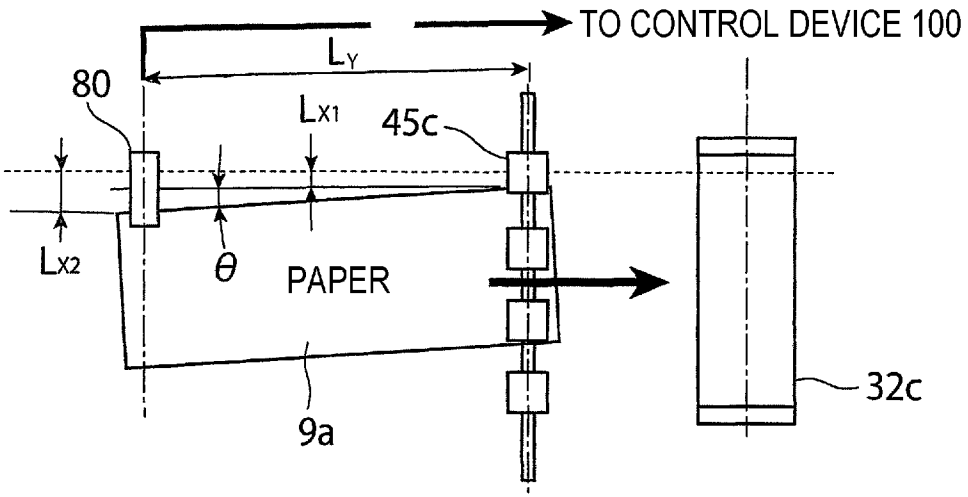

FIGS. 12A and 12B illustrate an image forming apparatus according to Exemplary Embodiment 2. In Exemplary Embodiment 2, the position of a recording medium in the transverse direction can be detected multiple times by the detection unit. The transport unit does not execute an adjusting operation if the position of the recording medium in the transverse direction is detected multiple times by the detection unit.

That is, with the controller 101 of the control device 100 according to Exemplary Embodiment 2, as illustrated in FIGS. 12A and 12B, the position of an edge portion of the long paper 9*a* in the transverse direction is detected by the sheet sensor 80 multiple times (e.g., twice) in total, at locations corresponding to both the leading and trailing edge portions of the long paper 9*a* in the transport direction. Misregistration and skew of the long paper 9*a* may be thus detected.

At this time, as illustrated in FIGS. 12A and 12B, based on detection results from the sheet sensor 80 obtained by performing detections multiple times, the controller 101 of the control device 100 determines that, at the location corresponding to the leading edge portion of the long paper 9*a*, the position of the edge portion of the long paper 9*a* in the transverse direction is displaced by the amount of misregistration $L_X$ with respect to the proper position, and the long paper 9*a* has a skew of an angle θ.

The angle θ of skew of the long paper 9*a* is determined by the controller 101 of the control device 100 by performing the following calculation: $\theta=\arctan(L_{X2}-L_{X1})/L_y$, where $L_{X1}$ is the amount of misregistration at a location corresponding to the leading edge portion of the long paper 9*a* in the transport direction, $L_{X2}$ is the amount of misregistration at a location corresponding to the trailing edge portion of the long paper 9*a* in the transport direction, and $L_y$ is the distance between the leading and trailing edge portions of the long paper 9*a* in the transport direction. The controller 101 of the control device 100 determines the direction of skew of the long paper 9*a* based on whether the value of $(L_{X2}-L_{X1})$ is positive or negative.

Figure 13:
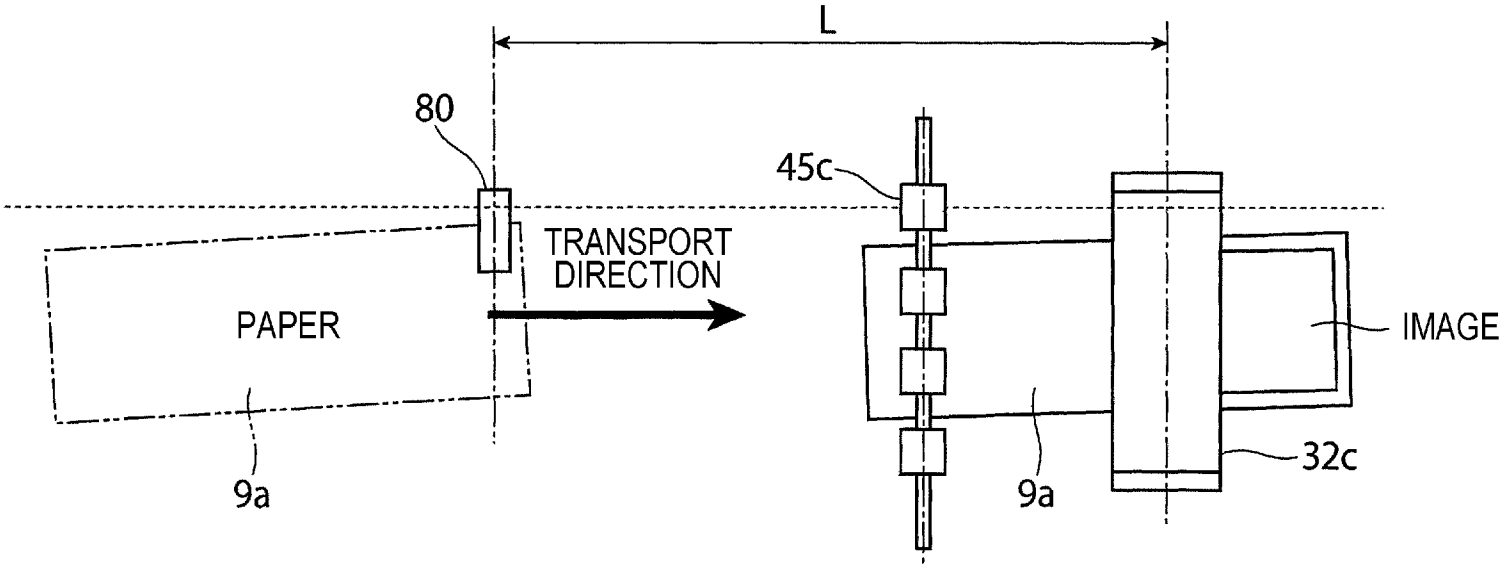
FIG. 13 illustrates operation of the image forming apparatus according to Exemplary Embodiment 2 of the present disclosure.

Then, as illustrated in FIG. 13, the controller 101 of the control device 100 causes an image to be formed in each of the image forming devices 20 (Y, M, C, and K) for yellow (Y), magenta (M), cyan (C) and black (K) such that the image is displaced and tilted (rotated), with respect to a position at which to normally form an image, by the distance $L_X$, which corresponds to the amount of misregistration of an edge portion of the long paper 9*a*, and the angle θ of skew of the long paper 9*a*.

At this time, as illustrated in FIG. 12B, the controller 101 of the control device 100 causes the long paper 9*a* to be transported to the second transfer position of the intermediate transfer device 30 with the long paper 9*a* being misregistered and skewed as it is, without the misregistration of the long paper 9*a* being corrected by the sheet transport roller pair 45*c* serving as registration rollers. Then, at the second transfer position of the intermediate transfer device 30, a toner image formed on the intermediate transfer belt 31 at a position adjusted in accordance with the amount of misregistration $L_{X1}$ and angle of skew θ of the long paper 9*a* is transferred onto the long paper 9*a*.

At that time, even provided that the position of the sheet sensor 80 satisfies the condition $L>L_0$ mentioned above, there is a possibility that at the moment when the sheet sensor 80 detects an edge portion of the long paper 9*a* located downstream in the transport direction, an image forming operation may have already started in each of the image forming devices 20 (Y, M, C, and K) for yellow (Y), magenta (M), cyan (C), and black (K).

Accordingly, to ensure that the position at which to form an image in each of the image forming devices 20 (Y, M, C, and K) for yellow (Y), magenta (M), cyan (C), and black (K) can be controlled by the controller 101 of the control device 100 upon detecting skew of the long paper 9*a*, it is desirable, while satisfying the above-mentioned condition $L>L_0$, to detect skew of the long paper 9*a* at the earliest possible time, not at a location corresponding to the downstream end portion of the long paper 9*a* in the transport direction but at a location corresponding to an intermediate position of the long paper 9*a* in the transport direction.

As described above, Exemplary Embodiment 2 may obviate the time necessary for executing a registration operation that brings a recording medium into abutment against the sheet transport roller pair 45*c* serving as registration rollers. This may reduce the time necessary for forming an image.

Embodiment 2 is otherwise similar in configuration and operation to Exemplary Embodiment 1 mentioned above, and thus will not be described in further detail.

Although the foregoing description of the exemplary embodiments is directed to a case where the recording medium used is the long paper 9*a* having a length in the transport direction greater than the length of common recording paper, it is needless to mention that even if common recording paper is used as a recording medium, a process similar to the process according to each of the above-mentioned exemplary embodiments may be performed if the recording paper 9 used is one having a predefined length in the transport direction, such as an A3-size recording paper.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image forming unit that forms an image on a recording medium, the image forming unit including:

a plurality of image carrying units, each image carrying unit carrying an image of a different color, an intermediate transfer belt that receives an image transferred to the intermediate transfer belt from each image carrying unit, and a transfer unit that transfers the image present on the intermediate transfer belt to the recording medium, a reversal transport unit that reverses front and back sides of the recording medium having an image formed by the image forming unit, and then transports the recording medium to the image forming unit;

a sensor disposed in a transport path of the reversal transport unit to detect a position of the recording medium in a transverse direction transverse to a transport direction, the transport direction being a direction of transport of the recording medium; and a processor programmed to adjust a position of an image in the image forming unit in accordance with the position of the recording medium detected by the sensor, wherein the plurality of image carrying units include a most upstream image carrying unit, the most upstream image carrying unit being an image carrying unit located most upstream in a direction of movement of the intermediate transfer belt among the plurality of image carrying units, and a distance from the most upstream image carrying unit to the transfer unit in the direction of movement of the intermediate transfer belt is greater than or equal to a distance from the sensor to the transfer unit in the transport direction.

2. The image forming apparatus according to claim 1, wherein the reversal transport unit includes a reversal transport path that reverses the transport direction of the recording medium to reverse front and back sides of the recording medium, and wherein the sensor is disposed downstream of the reversal transport path in the transport direction.

3. The image forming apparatus according to claim 2, wherein the sensor is disposed at a position in the reversal transport path where the recording medium is transported in a planar manner.

4. An image forming apparatus comprising:

an image forming unit that forms an image on a recording medium;

a reversal transport unit that reverses front and back sides of the recording medium having an image formed by the image forming unit, and then transports the recording medium to the image forming unit;

a sensor disposed in a transport path of the reversal transport unit to detect a position of the recording medium in a transverse direction transverse to a transport direction, the transport direction being a direction of transport of the recording medium; and a processor programmed to adjust a position of an image in the image forming unit in accordance with the position of the recording medium detected by the sensor, a transport unit that transports the recording medium to the image forming unit while performing an adjusting operation, the adjusting operation being an operation to adjust the position of the recording medium in the transverse direction, wherein the transport unit switches whether to execute the adjusting operation, in accordance with a number of times that the position of the recording medium in the transverse direction is detected by the sensor.

5. The image forming apparatus according to claim 4, wherein if the position of the recording medium in the transverse direction is detected a plurality of number of times by the sensor, the transport unit does not execute the adjusting operation, and an adjustment is made at a position where image formation is performed.

6. An image forming apparatus comprising:

an image forming means for forming an image on a recording medium, the image forming means including:

a plurality of image carrying units, each image carrying unit carrying an image of a different color, an intermediate transfer belt that receives an image transferred to the intermediate transfer belt from each image carrying unit, and a transfer unit that transfers the image present on the intermediate transfer belt to the recording medium, reversal transport means for reversing front and back sides of the recording medium having an image formed by the image forming means, and then transporting the recording medium to the image forming means;

detection means disposed in a transport path of the reversal transport means for detecting a position of the recording medium in a transverse direction transverse to a transport direction, the transport direction being a direction of transport of the recording medium; and adjustment means for adjusting a position of an image in the image forming means in accordance with the position of the recording medium detected by the detection means, wherein the plurality of image carrying units include a most upstream image carrying unit, the most upstream image carrying unit being an image carrying unit located most upstream in a direction of movement of the intermediate transfer belt among the plurality of image carrying units, and a distance from the most upstream image carrying unit to the transfer unit in the direction of movement of the intermediate transfer belt is greater than or equal to a distance from the detection means to the transfer unit in the transport direction.

* * * * *